US011200848B2

(12) United States Patent
Ma

(10) Patent No.: US 11,200,848 B2
(45) Date of Patent: Dec. 14, 2021

(54) BENDABLE DISPLAY PANEL, BENDABLE DISPLAY APPARATUS, AND BENDABLE DISPLAY DEVICE

(71) Applicant: WUHAN CHINA STAR OPTOELECTRONICS SEMICONDUCTOR DISPLAY TECHNOLOGY CO., LTD., Wuhan (CN)

(72) Inventor: Liang Ma, Wuhan (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 17/082,645

(22) Filed: Oct. 28, 2020

(65) Prior Publication Data

US 2021/0201812 A1 Jul. 1, 2021

(30) Foreign Application Priority Data

Dec. 31, 2019 (CN) ..... 201911405454.6

(51) Int. Cl.

| | |
|---|---|
| ***G09G 5/00*** | (2006.01) |
| ***G09G 3/3266*** | (2016.01) |
| ***G09F 9/30*** | (2006.01) |
| ***G09G 3/3275*** | (2016.01) |

(52) U.S. Cl.

CPC ..... *G09G 3/3266* (2013.01); *G09F 9/301* (2013.01); *G09G 3/3275* (2013.01)

(58) Field of Classification Search

CPC ..... G09G 3/3266; G09G 3/3275; G09G 2300/0426; G09G 2310/0221; G09F 9/30; G09F 9/301

See application file for complete search history.

(56) References Cited

U.S. PATENT DOCUMENTS

| | | | | |
|---|---|---|---|---|
| 2015/0269891 | A1 | 9/2015 | Yamazaki | |
| 2017/0032763 | A1* | 2/2017 | Cheong | G02F 1/133305 |
| 2017/0033123 | A1* | 2/2017 | Lv | H01L 27/1259 |
| 2017/0077212 | A1* | 3/2017 | Li | H01L 51/0097 |

(Continued)

FOREIGN PATENT DOCUMENTS

| | | | |
|---|---|---|---|
| CN | 104933994 | A | 9/2015 |
| CN | 108877527 | A | 11/2018 |

(Continued)

*Primary Examiner* — Joe H Cheng

(74) *Attorney, Agent, or Firm* — Osha Bergman Watanabe & Burton LLP

(57) ABSTRACT

The present disclosure provides a bendable display panel, a bendable display apparatus, and a bendable display device. The bendable display panel includes at least two non-bending areas, and at least one bending area disposed between two adjacent non-bending areas. Opposite sides of the at least one bending area are electrically connected to the adjacent non-bending areas respectively to form an integrated structure, wherein each of the at least two non-bending areas includes a display area provided with a gate array driving circuit, and a non-display area disposed at a periphery of the display area, the non-display area provided with an opening at a position corresponding to the at least one bending area.

10 Claims, 2 Drawing Sheets

(56) References Cited

U.S. PATENT DOCUMENTS

| | | | | |
|---|---|---|---|---|
| 2018/0040640 | A1* | 2/2018 | Takahashi | G09G 3/3233 |
| 2019/0165076 | A1* | 5/2019 | Lee | H01L 27/3276 |
| 2019/0244976 | A1* | 8/2019 | Zhu | H01L 27/124 |
| 2019/0325796 | A1* | 10/2019 | Chen | G09G 3/006 |
| 2019/0325818 | A1* | 10/2019 | Wang | G09G 3/3225 |
| 2019/0357366 | A1 | 11/2019 | Choi et al. | |
| 2020/0103942 | A1 | 4/2020 | Su et al. | |
| 2020/0126479 | A1* | 4/2020 | Yamasaki | G09G 3/3275 |
| 2020/0126488 | A1 | 4/2020 | Ouyang et al. | |
| 2020/0139672 | A1* | 5/2020 | Cao | B32B 27/06 |
| 2020/0152725 | A1* | 5/2020 | Chen | H01L 51/0097 |
| 2020/0310493 | A1* | 10/2020 | Kim | G06F 1/1609 |
| 2020/0380893 | A1* | 12/2020 | Park | G09F 9/301 |
| 2021/0064092 | A1* | 3/2021 | Kwon | G06F 1/1652 |
| 2021/0142707 | A1* | 5/2021 | Zheng | G09G 3/3225 |
| 2021/0174710 | A1* | 6/2021 | He | G06F 1/1652 |
| 2021/0193943 | A1* | 6/2021 | Ohsawa | C09K 11/06 |
| 2021/0201708 | A1* | 7/2021 | Wang | G09F 9/301 |

FOREIGN PATENT DOCUMENTS

| | | | |
|---|---|---|---|
| CN | 109243306 | A | 1/2019 |
| CN | 109686259 | A | 4/2019 |
| CN | 109727540 | A | 5/2019 |
| CN | 110047393 | A | 7/2019 |
| CN | 110277429 | A | 9/2019 |
| CN | 110504295 | A | 11/2019 |

* cited by examiner

BENDABLE DISPLAY PANEL, BENDABLE DISPLAY APPARATUS, AND BENDABLE DISPLAY DEVICE

CROSS-REFERENCE TO RELATED APPLICATION

This Application claims priority to Chinese Application No. CN201911405454.6, filed on Dec. 31, 2019. The entire contents of this application is incorporated herein by reference in its entirety.

FIELD OF INVENTION

The present disclosure relates to the field of display technologies, and more particularly, to a bendable display panel, a bendable display apparatus, and a bendable display device.

BACKGROUND OF INVENTION

In recent years, organic light emitting diode (OLED) displays have been reputed as next-generation displays, which have outstanding advantages of high contrast and brightness, rich colors, low driving voltage, and bendable performance. With the advancement of technology, OLED hard screen (non-bendable) technology has been gradually optimized. Currently, OLEDs mostly adopt low-temperature poly-silicon (LTPS) process and are designed with a 7T1C circuit structure, a light-emitting area of the OLED display is configured to a display area and including a 7T1C pixel driving circuit, a plurality of light-emitting pixels, and a plurality of connection lines. The GOA area is usually arranged along a long side of the panel, and stably provides scanning signals, reset (VI) signals, and enable (EM) signals to the pixel driving circuit to control the signal writing process of thin-film transistors (TFT). A plurality of power lines of the gate on array (GOA) converge into a frame area, and an external power supply and IC control the voltage. Generally, a plurality of VDD and data signal lines are parallel to the long side of the panel and converge to the frame area.

However, due to line resistances of the plurality of VDD signal lines, a phenomenon of IR drop is more obvious, that is, a voltage drops along the plurality of VDD signal lines causes a difference in display brightness. With the development of the folding OLED displays, the phenomenon of IR drop is more obvious, and due to the GOA area of the folding OLED displays be extended accordingly, a refresh frequency of the folding OLED displays expanded state be correspondingly reduced. Therefore, corresponding improvements need to be made to improve the phenomenon of IR drop.

SUMMARY OF INVENTION

The embodiments of the present disclosure provide a bendable display panel to solve the problems of the difference in display brightness caused by a phenomenon of IR drop and a refresh frequency of the folding OLED displays expanded state be correspondingly reduced of the prior art.

An embodiment of the present disclosure provides a bendable display panel including at least two non-bending areas; and at least one bending area disposed between two adjacent non-bending areas, opposite sides of the at least one bending area are electrically connected to the two adjacent non-bending areas respectively to form an integrated structure; wherein each of the at least two non-bending areas includes a display area provided with a gate on array driving circuit; and a non-display area disposed at a periphery of the display area, the non-display area provided with an opening at a position corresponding to the at least one bending area.

In some embodiments, the bending area includes a bending line.

In some embodiments, the non-display area includes at least one gate on array controller, disposed in parallel with a plurality of vertical VDD signal lines of the gate on array driving circuit, electrically connected to at least one of a plurality of scanning lines of the gate on array driving circuit, and configured to independently stably provide the gate on array driving circuit a scan signal, a reset signal, and an enable signal; and at least one frame disposed in parallel with lateral ones of the plurality of scanning lines of the gate on array driving circuit, and electrically connected to at least one of a plurality of data signal lines of the gate on array driving circuit.

In some embodiments, each of the at least two non-bending areas comprises at least one the frame.

In some embodiments, the frame of one of the non-bending areas is connected to the plurality of the VDD signal lines, and the frame of the other one of the non-bending areas is connected to the plurality of the data signal lines for controlling a VDD signal and a data signal respectively.

In some embodiments, the frame is connected to the plurality of the VDD signal lines and the plurality of the data signal lines at the same time.

In some embodiments, when the bendable display panel is folded along the bending line, the display areas are symmetry.

In some embodiments, the GOA driving circuit is a 7T1C type circuit.

In some embodiments, during bending, the GOA controller of the non-bending area independently controls partial of the display area in the non-bending area, reducing the scanning time of the GOA, and realizes separately control the plurality of VDD signal line by using multiple frames. Moreover, reducing the overall length of the plurality of VDD signal lines, so reducing the phenomenon of IR drop and improving the display uniformity.

The embodiment of the present disclosure further provides a bendable display apparatus including at least two non-bending areas; and at least one bending area disposed between two adjacent non-bending areas, opposite sides of the at least one bending area are electrically connected to the two adjacent non-bending areas respectively to form an integrated structure; wherein each of the at least two non-bending areas includes a display area provided with a gate on array driving circuit; and a non-display area disposed at a periphery of the display area, the non-display area provided with an opening at a position corresponding to the at least one bending area.

In some embodiments, the bending area includes a bending line.

In some embodiments, the non-display area includes at least one gate on array controller, disposed in parallel with a plurality of vertical VDD signal lines of the gate on array driving circuit, electrically connected to at least one of a plurality of scanning lines of the gate on array driving circuit, and configured to independently stably provide the gate on array driving circuit a scan signal, a reset signal, and an enable signal; and at least one frame disposed in parallel with lateral ones of the plurality of scanning lines of the gate on array driving circuit, and electrically connected to at least one of a plurality of data signal lines of the gate on array driving circuit.

In some embodiments, each of the at least two non-bending areas comprises at least one the frame.

In some embodiments, the frame of one of the non-bending areas is connected to the plurality of the VDD signal lines, and the frame of the other one of the non-bending areas is connected to the plurality of the data signal lines for controlling a VDD signal and a data signal respectively.

In some embodiments, the frame is connected to the plurality of the VDD signal lines and the plurality of the data signal lines at the same time.

In some embodiments, when the bendable display panel is folded along the bending line, the display areas are symmetry.

In some embodiments, the GOA driving circuit is a 7T1C type circuit.

An embodiment of the present disclosure further provides a bendable display device including at least two non-bending areas; and at least one bending area disposed between two adjacent non-bending areas, opposite sides of the at least one bending area are electrically connected to the two adjacent non-bending areas respectively to form an integrated structure; wherein each of the at least two non-bending areas includes a display area provided with a gate on array driving circuit; and a non-display area disposed at a periphery of the display area, the non-display area provided with an opening at a position corresponding to the at least one bending area.

In some embodiments, the bending area includes a bending line.

In some embodiments, the non-display area includes at least one gate on array controller, disposed in parallel with a plurality of vertical VDD signal lines of the gate on array driving circuit, electrically connected to at least one of a plurality of scanning lines of the gate on array driving circuit, and configured to independently stably provide the gate on array driving circuit a scan signal, a reset signal, and an enable signal; and at least one frame disposed in parallel with lateral ones of the plurality of scanning lines of the gate on array driving circuit, and electrically connected to at least one of a plurality of data signal lines of the gate on array driving circuit.

In some embodiments, each of the at least two non-bending areas comprises at least one the frame.

In some embodiments, the frame of one of the non-bending areas is connected to the plurality of the VDD signal lines, and the frame of the other one of the non-bending areas is connected to the plurality of the data signal lines for controlling a VDD signal and a data signal respectively.

In some embodiments, the frame is connected to the plurality of the VDD signal lines and the plurality of the data signal lines at the same time.

In some embodiments, when the bendable display panel is folded along the bending line, the display areas are symmetry.

In some embodiments, the GOA driving circuit is a 7T1C type circuit.

The present disclosure provides a bendable display panel, a bendable display apparatus, and a bendable display device. The bendable display panel includes at least two non-bending areas, and at least one bending area disposed between two adjacent non-bending areas, opposite sides of the at least one bending area are electrically connected to the adjacent non-bending areas respectively to form an integrated structure, wherein each of the at least two non-bending areas includes a display area provided with a gate array driving circuit, and a non-display area disposed at a periphery of the display area, the non-display area provided with an opening at a position corresponding to the at least one bending area. The present disclosure divides the GOA driving circuit to implement controlling the screens respectively, ensuring the refresh frequency of the bending screen, and reducing the length of the plurality of VDD lines, thereby reducing the phenomenon of IR drop and improving the uniformity of the display.

DESCRIPTION OF DRAWINGS

In reference to the drawings, the specific embodiments of the present disclosure will be described in detail below, so that the technical solution and other beneficial effects of the present disclosure can become obvious.

DETAILED DESCRIPTION OF PREFERRED EMBODIMENTS

Figure 1:
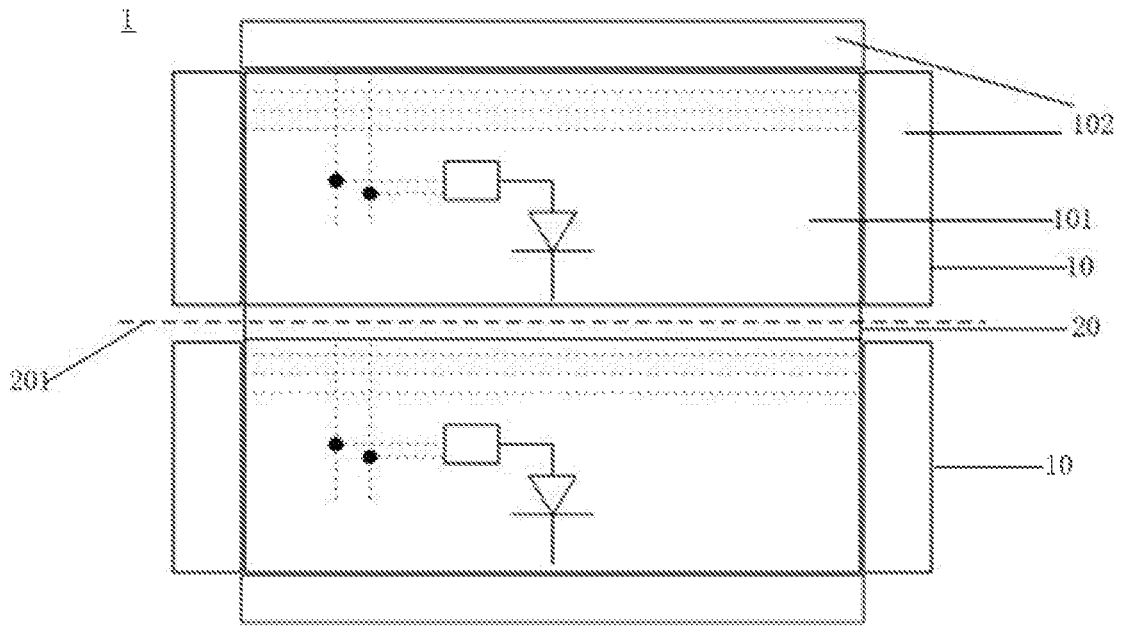
FIG. 1 is a schematic structural diagram of a display panel according to an embodiment of the present disclosure.

In the following, the technical solutions in the embodiments of the present disclosure will be clearly and completely described with reference to the figures. Obviously, the described embodiments are only some embodiments of the present disclosure, not all the embodiments. Based on the embodiments in the present disclosure, all other embodiments obtained by a person of ordinary skill in the art without creative steps shall fall within the protection scope of the present disclosure.

In the description of the present disclosure, it should be understood that the terms of center, longitudinal, transverse, length, width, thickness, upper, lower, front, rear, left, right, vertical, horizontal, top, bottom, inside, outside, clockwise, counterclockwise, etc. or a positional relationship based on orientation or position shown in the figures are only for the convenience of describing the present disclosure and simplifying the description, rather than indicating or implying the device or element referred to must have a specific orientation, structure, or operation. Therefore, it cannot be understood as a limitation of the present disclosure.

In addition, the terms "first" and "second" are used for descriptive purposes only, and cannot be understood as indicating or implying relative importance or implicitly indicating the number of technical features indicated. Therefore, the features defined as "first" and "second" may explicitly or implicitly include one or more of the features. In the description of the present disclosure, the meaning of "a plurality" is two or more, unless specifically defined otherwise.

In the description of the present disclosure, it should be noted that the terms "installation", "linked", and "connected" should be understood in a broad sense unless explicitly stated and limited otherwise. For example, it can be fixed connection, removable connection, or integral connection; it can be mechanical or electrical connection; it can be directly connected, indirectly connected through an intermediate medium, or it can be an internal communication of two elements. For those of ordinary skill in the art, the specific meanings of the above terms in the present disclosure can be understood on a case-by-case basis.

In the present application, unless explicitly specified and defined otherwise, a first feature being "on" or "under" a second feature may be that the first feature and the second feature are in direct contact, or the first feature and the second feature are in indirect contact through an intermediary. In addition, the first feature being "on", "over" and "above" the second feature may be that the first feature is just above or diagonally above the second feature, or merely represents that a horizontal height of the first feature is higher than that of the second feature. The first feature being "under", "below" and "underneath" the second feature may be that the first feature is just below or diagonally below the second feature, or merely represents that the horizontal height of the first feature is lower than that of the second feature.

The following disclosure provides many different implementations or examples for implementing different structures of the present disclosure. To simplify the disclosure of the present disclosure, the components and settings of specific embodiments are described below. Of course, they are merely embodiments and are not intended to limit the present disclosure. In addition, the present disclosure may repeat reference numbers and/or reference letters in different embodiments, and such repetition is for simplicity and clarity and does not indicate the relationship between the various embodiments and/or settings discussed. In addition, embodiments of various specific processes and materials are provided in the present disclosure, but those of ordinary skill in the art may be aware of the application of other processes and/or the use of other materials.

Figure 2:
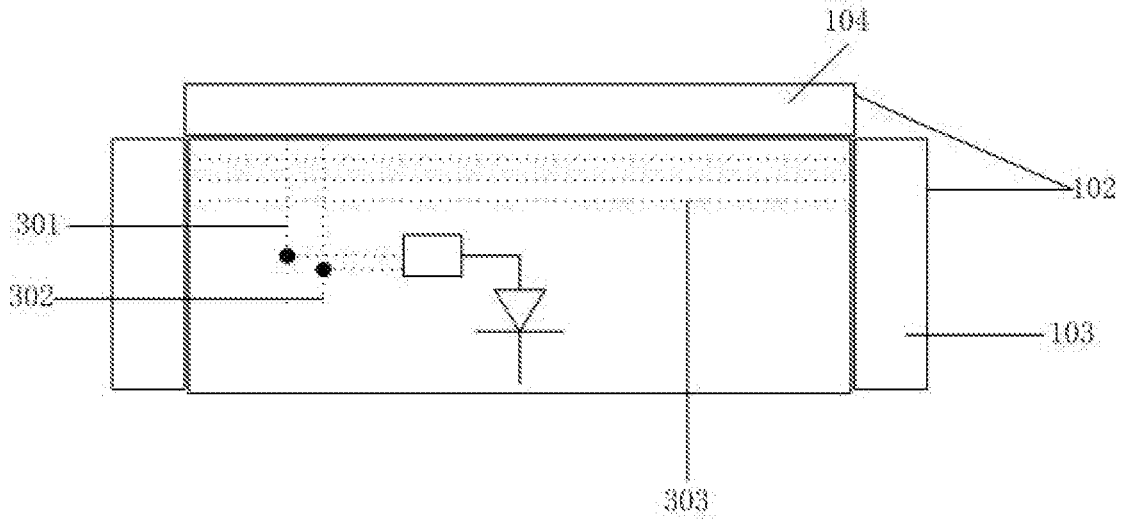
FIG. 2 is a schematic structural diagram of the non-bending area.

Specifically, referring to FIGS. 1 to 2, an embodiment of the present disclosure provides a bendable display panel 1 including at least two non-bending areas 10 and at least one bending area 20 disposed between two adjacent non-bending areas 10, opposite sides of the at least one bending area 20 are electrically connected to the two adjacent non-bending areas 10 respectively to form an integrated structure, wherein each of the at least two non-bending areas 10 includes a display area 101 provided with a gate on array (GOA) circuit, and a non-display area 102 disposed at a periphery of the display area 101, the non-display area 102 provided with an opening at a position corresponding to the at least one bending area 20.

The bending area 20 includes a bending line 201.

The non-display area 102 includes at least one GOA controller 103, disposed in parallel with a plurality of vertical VDD signal lines 301 of the GOA driving circuit, electrically connected to at least one of a plurality of scanning lines 303 of the GOA driving circuit, and configured to independently stably provide the GOA driving circuit a scan signal, a reset signal, and an enable signal. At least one frame 104 disposed in parallel with lateral ones of the plurality of scanning lines 303 of the GOA driving circuit, and are electrically connected to at least one of a plurality of data signal lines 302 of the GOA driving circuit.

Each of the at least two non-bending areas 10 includes a plurality of frames 104.

The frame 104 of one of the non-bending areas 10 is connected to the plurality of VDD signal lines 301, and the frame 104 of the other one of the non-bending areas 10 is connected to the plurality of the data signal lines 302 for controlling a VDD signal and a data signal respectively.

When the bendable display panel is folded along the bending line 201, the two display areas 101 are symmetry.

The GOA driving circuit may be a 7T1C type circuit.

Figure 3:
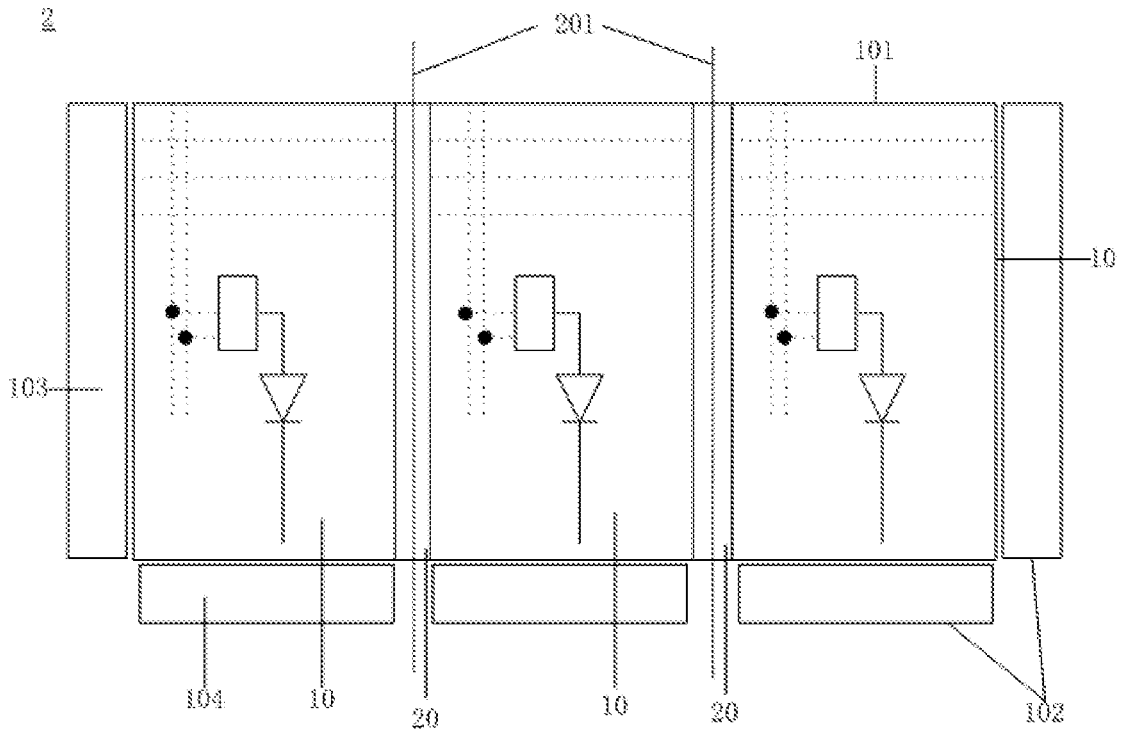
FIG. 3 is a schematic structural diagram of a display panel according to another embodiment of the present disclosure.

As shown in FIG. 3, another embodiment of the present disclosure provides a bendable display panel 2 including three non-bending areas 10 and two bending areas 20 disposed between two adjacent non-bending areas, opposite sides of the at least one bending area 20 are electrically connected to the two adjacent non-bending areas 10 respectively to form an integrated structure. Each of the non-bending areas 10 includes a display area 101 provided with a GOA driving circuit, and a non-display area 102 disposed at a periphery of the display area 101, the non-display area 102 provided with an opening at a position corresponding to the two bending areas 20.

The bending area 20 includes a bending line 201.

The non-display area 102 includes at least one GOA controller 103, which is disposed in parallel with a plurality of vertical VDD signal lines of the GOA driving circuit, electrically connected to at least one of a plurality of scanning lines of the GOA driving circuit, and configured to independently stably provide the GOA driving circuit a scan signal, a reset signal, and an enabling signal, and at least one frame 104 disposed in parallel with lateral ones of the plurality of scanning lines of the GOA driving circuit, and electrically connected to at least one of data signal lines of the GOA driving circuit.

Each of the three non-bending areas includes at least one the frame 104, the at least one frame 104 is connected to the plurality of the VDD signal lines and the plurality of the data signal lines at the same time.

There is at least one GOA controller 103 disposed in each of the non-bending areas.

When the bendable display panel is folded along the bending line 201, the three display areas are symmetry.

The GOA driving circuit may be a 7T1C type circuit.

The embodiment of the present disclosure further provides a bendable display apparatus, which includes all the features of the bendable display panel described above, and will not be described one by one.

The embodiment of the present disclosure further provides a bendable display device, which includes all the features of the bendable display device described above, and will not be described one by one.

An embodiment of the present disclosure provides a bendable display panel 1 including two non-bending areas 10 and one bending area 20 disposed between two adjacent non-bending areas 10, opposite sides of the bending area 20 are electrically connected to the two adjacent non-bending areas respectively to form an integrated structure. The non-bending area 10 includes a display area 101 provided with a GOA driving circuit. A non-display area 102 disposed at a periphery of the display area 101, the non-display area 102 provided with an opening at a position corresponding to the bending area 20. Embodiments of the present disclosure divide the GOA driving circuit to implement controlling the screens respectively, ensuring the refresh frequency of the bending screen, and reducing the length of the plurality of VDD lines, thereby reducing the phenomenon of IR drop and improving the uniformity of the display.

In the above embodiments, the description of each embodiment has its own emphasis. For a part that is not described in detail in the embodiment, reference may refer to related descriptions in other embodiments.

The description above providing and describing embodiments of the flexible display panel, bendable display apparatus, and bendable display device in detail to explain the principles and implementation of the present disclosure. The description of the above embodiments is only used to help understand the technical solution and core idea of the present disclosure. It should be noted that, for those of ordinary skill in the art, without departing from the principle of the present disclosure, several improvements and retouches can be made, and these improvements and retouches are within the protection scope of the present disclosure.

What is claimed is:

1. A bendable display panel, comprising:

at least two non-bending areas; and at least one bending area disposed between two adjacent non-bending areas, opposite sides of the at least one bending area are electrically connected to the two adjacent non-bending areas respectively to form an integrated structure;

wherein each of the at least two non-bending areas comprises:

a display area; and a non-display area disposed at a periphery of the display area, the non-display area provided with an opening at a position corresponding to the at least one bending area, the non-display area comprises at least one gate on array controller disposed in parallel with a plurality of VDD signal lines of the display area, wherein the at least one gate on array controller is electrically connected to at least one of a plurality of scanning lines of the display area, and configured to independently stably provide a scan signal, a reset signal, and an enable signal, and wherein a plurality of frames disposed in parallel with lateral ones of the plurality of scanning lines of the display area, and electrically connected to a plurality of data signal lines of the display area; and wherein each of the at least two non-bending areas comprises one of the frames, and one of the frames of one of the non-bending areas is connected to some of the VDD signal lines, and another one of the frames of another one of the non-bending areas is connected to some of the data signal lines for controlling a VDD signal and a data signal respectively.

2. The bendable display panel as claimed in claim 1, wherein the bending area comprises a bending line.

3. The bendable display panel as claimed in claim 2, wherein when the bendable display panel is folded along the bending line, the display areas are symmetry.

4. The bendable display panel as claimed in claim 1, wherein the frame is connected to some of the VDD signal lines and some of the data signal lines.

5. A bendable display apparatus, comprising a bendable display panel which comprising:

at least two non-bending areas; and at least one bending area disposed between two adjacent non-bending areas, opposite sides of the at least one bending area are electrically connected to the two adjacent non-bending areas respectively to form an integrated structure;

wherein each of the at least two non-bending areas comprises:

a display area; and a non-display area disposed at a periphery of the display area, the non-display area provided with an opening at a position corresponding to the at least one bending area, the non-display area comprises at least one gate on array controller disposed in parallel with a plurality of VDD signal lines of the display area, wherein the at least one gate on array controller is electrically connected to at least one of a plurality of scanning lines of the display area, and configured to independently stably provide a scan signal, a reset signal, and an enable signal, and wherein a plurality of frames disposed in parallel with lateral ones of the plurality of scanning lines of the display area, and electrically connected to a plurality of data signal lines of the display area; and wherein each of the at least two non-bending areas comprises one of the frames, and one of the frames of one of the non-bending areas is connected to some of the VDD signal lines, and another one of the frames of another one of the non-bending areas is connected to some of the data signal lines for controlling a VDD signal and a data signal respectively.

6. The bendable display apparatus as claimed in claim 5, wherein the bending area comprises a bending line.

7. The bendable display apparatus as claimed in claim 6, wherein when the bendable display panel is folded along the bending line, the display areas are symmetry.

8. The bendable display apparatus as claimed in claim 5, wherein the frame is connected to some of the VDD signal lines and some of the data signal lines.

9. A bendable display device, comprising a bendable display apparatus comprising a bendable display panel comprising:

at least two non-bending areas; and at least one bending area disposed between two adjacent non-bending areas, opposite sides of the at least one bending area are electrically connected to the two adjacent non-bending areas respectively to form an integrated structure;

wherein each of the at least two non-bending areas comprises:

a display area; and a non-display area disposed at a periphery of the display area, the non-display area provided with an opening at a position corresponding to the at least one bending area, the non-display area comprises at least one gate on array controller disposed in parallel with a plurality of VDD signal lines of the display area, wherein the at least one gate on array controller is electrically connected to at least one of a plurality of scanning lines of the display area, and configured to independently stably provide a scan signal, a reset signal, and an enable signal, and wherein a plurality of frames disposed in parallel with lateral ones of the plurality of scanning lines of the display area, and electrically connected to a plurality of data signal lines of the display area; and wherein each of the at least two non-bending areas comprises one of the frames, and one of the frames of one of the non-bending areas is connected to some of the VDD signal lines, and another one of the frames of another one of the non-bending areas is connected to some of the data signal lines for controlling a VDD signal and a data signal respectively.

10. The bendable display device as claimed in claim 9, wherein the bending area comprises a bending line.

* * * * *